US007443371B2

(12) United States Patent
Fujikawa

(10) Patent No.: US 7,443,371 B2
(45) Date of Patent: Oct. 28, 2008

(54) ELECTRO-OPTIC APPARATUS, DRIVING METHOD FOR THE SAME, AND ELECTRONIC APPLIANCE

(75) Inventor: Shinsuke Fujikawa, Chino (JP)

(73) Assignee: Seiko Epson Corporation, Tokyo (JP)

( * ) Notice: Subject to any disclaimer, the term of this patent is extended or adjusted under 35 U.S.C. 154(b) by 669 days.

(21) Appl. No.: 10/865,851

(22) Filed: Jun. 14, 2004

(65) Prior Publication Data

US 2005/0012726 A1 Jan. 20, 2005

(30) Foreign Application Priority Data

Jun. 20, 2003 (JP) ..... 2003-176404

(51) Int. Cl.
*G09G 3/36* (2006.01)

(52) U.S. Cl. ..... 345/96; 345/98; 345/87

(58) Field of Classification Search ..... 345/204, 345/690–691, 208–209, 211–214, 97, 96, 345/98–100; 326/37
See application file for complete search history.

(56) References Cited

U.S. PATENT DOCUMENTS 5,712,652 A * 1/1998 Sato et al. ..... 345/90
6,762,737 B2 * 7/2004 Kajihara et al. ..... 345/89
6,819,311 B2 * 11/2004 Nose et al. ..... 345/100
6,853,370 B2 * 2/2005 Numao ..... 345/204
6,873,321 B2 * 3/2005 Tsutsui ..... 345/204
7,038,650 B2 * 5/2006 Tsutsui ..... 345/98
7,081,875 B2 * 7/2006 Yokoyama et al. ..... 345/90

FOREIGN PATENT DOCUMENTS

EP 544427 A2 * 6/1993 ..... 345/55
JP A-8-286170 11/1996
JP 2003-084718 * 10/2001

OTHER PUBLICATIONS

"Liquid Crystal Panel with a Built-In Memory", *Liquid Crystal*, 2002, vol. 6, 2nd issue, pp. 208-211 (w/English-language translation).

* cited by examiner

*Primary Examiner*—Duc Q Dinh
(74) *Attorney, Agent, or Firm*—Oliff & Berridge, PLC

(57) ABSTRACT

To provide an electro-optic apparatus, a driving method for the same, and an electronic appliance that can reduce power consumption, a liquid crystal display device includes a plurality of scan lines, a plurality of data lines, pixel electrodes disposed at each intersection of the scan lines and the data lines, and counter electrodes disposed facing the pixel electrodes, with the counter electrodes being set at a predetermined potential. A memory circuit stores logic corresponding to a tone of a data signal supplied from a data line to the pixel electrode in accordance with logic of a polarity signal. A power supply selecting circuit switches the power supply supplied to the memory circuit based on switches in the logic of the polarity signal. The read circuit switches a read of logic stored in the storage circuit based on switches in the logic of the polarity signal and supplies the pixel electrode.

9 Claims, 6 Drawing Sheets

ELECTRO-OPTIC APPARATUS, DRIVING METHOD FOR THE SAME, AND ELECTRONIC APPLIANCE

BACKGROUND OF THE INVENTION

1. Field of Invention

The present invention relates to an electro-optic apparatus, a driving method for the same, and an electronic appliance.

2. Description of Related Art

Among related art electric optical apparatus, such as liquid crystal display apparatus, apparatus equipped with memories in each pixel to reduce power consumption are disclosed in Japanese Unexamined Patent Publication No. H08-286170 (FIG. 10).

FIG. 8 is a circuit schematic showing one example of such a liquid crystal display apparatus. FIG. 9 is a timing chart showing how the same apparatus is driven. As shown in FIG. 8, this liquid crystal display apparatus is equipped with a plurality of scan line pairs Yai, Ybi (where i is a natural number in a range of 1 to n) and a plurality of data lines Xj (where j is a natural number in a range of 1 to m) that intersect the scan line pairs. Respective pixels Pij are formed corresponding to intersections between the respective scan line pairs Yai, Ybi and the data lines Xj.

In each pixel Pij, a liquid crystal capacitive element 93 is formed by sandwiching liquid crystals between a pixel electrode 91 and a counter electrode 92 that is supplied with a counter electrode signal COM commonly supplied to every pixel. Each pixel Pij also includes an analog switch 94, a latch circuit 95, and a read circuit 96. The data line Xj is connected via the analog switch 94, the latch circuit 95, and the read circuit 96 to the pixel electrode 91.

The analog switch 94 is connected to the scan line pair Yai, Ybi and is turned on when a scan signal WRT at a high level is supplied on one signal line out of the pair, the signal line Yai, and an inverted signal WRTX of the scan signal WRT at a low level is simultaneously supplied on the other signal line, the signal line Ybi. As a result, logic that corresponds to a tone is read into pixel electrode 91 via the data line Xj.

The latch circuit 95 is composed of two inverters 95*a*, 95*b* and is supplied with power via two (i.e., plus and minus) power supply lines 97*a*, 98*b*. When logic is read and the analog switch 94 has then been turned off, the latch circuit 95 thereafter holds the logic at that time.

The read circuit 96 is composed of an N-channel TFT 96*a* and a P-channel TFT 96*b*. The respective drains of the TFTs are connected to the pixel electrode 91. The source of the N-channel TFT 96*a* is connected to the output terminal of the inverter 95*b*, while the source of the P-channel TFT 96*b* is connected to the output terminal of the inverter 95*a*. The respective gates of the TFTs are connected to a polarity line 98. A polarity signal POL that cyclically inverts the polarity is supplied via the polarity line 98. Accordingly, one of the N-channel TFT 96*a* and the P-channel TFT 96*b* is turned ON according to the level (polarity) of the polarity signal (POL) supplied to the polarity line 98. Specifically, in a state where logic is stored by the latch circuit 95, when the polarity signal POL is at a high level, the N-channel TFT 96*a* is turned ON and the logic outputted from the inverter 95*b* is outputted to the pixel electrode 91.

When the polarity signal POL is at a low level, the P-channel TFT 96*b* is turned ON and the logic output from the inverter 95*a* is output to the pixel electrode 91. In this way, logic, or the inverse of such logic, is applied to the pixel electrode 91 during a read according to the level of the polarity signal POL supplied to the polarity line 98 so that the electric field applied to the liquid crystals is switched to drive the liquid crystals with an alternating current (AC).

The operation during the driving of the respective pixels in this kind of construction is described below with reference to FIG. 9. It should be noted that when the polarity signal POL is at the high level, the logic read into the pixel electrode 91 has a potential VDD for a display of black and a potential VSS (<VDD) for a display of white. Similarly, when the polarity signal POL is at the low level, the logic read into the pixel electrode 91 has the potential VSS for a display of black and the potential VDD for a display of white.

The respective power supply voltages supplied to the latch circuit 95 via the power supply lines 97*a*, 97*b* are set at the potentials VDD and VSS. Accordingly, the logic held in the latch circuit 95 has the respective potentials VDD and VSS at the high level and the low level. The latch circuit 95 (the inverters 95*a*, 95*b*) outputs the potential VDD that is the high level and the potential VSS that is the low level corresponding to the held logic to the read circuit 96.

When the polarity signal POL is at the high level, the latch circuit 95 outputs, via the N-channel TFT 96*a*, the high-level potential VDD for displaying black to the pixel electrode 91 or the low-level potential VSS for displaying white to the pixel electrode 91. After this, when the polarity signal POL switches to the low level with the same logic being held, the latch circuit 95 outputs, via the P-channel TFT 96*b*, the low-level potential VSS for displaying black to the pixel electrode 91 or the high-level potential VDD for displaying white to the pixel electrode 91. This is also the case when the polarity signal POL switches from the low level to the high level.

Here, the potential of the counter electrode signal COM supplied to the counter electrode 92 also undergoes a transition corresponding to the level of the polarity signal POL. When the electrode signal POL is at the high level, the counter electrode signal COM is set at a predetermined potential Vm that is lower than the potential VSS. When the electrode signal POL is at the low level, the counter electrode signal COM is set at a predetermined potential Vp that is higher than the potential VDD. The potential of the counter electrode signal COM has to be cyclically inverted in accordance with the polarity signal POL in this way since the latch circuit 95 is only capable of assuming two kinds of logic (levels) during AC driving of the liquid crystals.

By doing so, during a display of black, when the polarity signal POL is at the high level, a voltage (VDD-Vm) is applied between the pixel electrode 91 and the counter electrode 92. When the polarity signal POL is at the low level, a voltage (Vp-VSS) is applied between the pixel electrode 91 and the counter electrode 92. In the same way, during a display of white, when the polarity signal POL is at the high level, a voltage (VSS-Vm) is applied between the pixel electrode 91 and the counter electrode 92. When the polarity signal POL is at the low level, a voltage (Vp-VDD) is applied between the pixel electrode 91 and the counter electrode 92. By doing so, a tone is held by the pixel Pij while the liquid crystals are driven with AC.

SUMMARY OF THE INVENTION

However, if the potential of the counter electrode signal COM commonly supplied to every pixel is inverted in synchronization with the polarity signal POL to realize AC driving of the liquid crystals, there will be an increase in the load capacity of all of the counter electrodes 92 so that the peak current during an inversion operation is increased. Power supplies are normally designed in view of the peak current, so that it becomes necessary to use a power supply with a sufficiently high driving capacity to cope with this peak current during the inversion operation. As the driving capacity of the power supply increases, there is also an increase in power consumption.

The present invention provides an electro-optic apparatus, a driving method for the same, and an electronic appliance that can reduce power consumption.

An electro-optic apparatus according to an aspect of the present invention includes a plurality of scan lines, a plurality of data lines that intersect the scan lines, pixel electrodes disposed at respective intersections of the scan lines and the data lines, counter electrodes disposed opposite the pixel electrodes, and electro-optic material disposed between the respective pixel electrodes and the respective counter electrodes. The counter electrodes are set at a predetermined potential. The electro-optic apparatus further includes: a memory to store logic corresponding to a tone of a data signal supplied from the data lines to the pixel electrodes in accordance with logic of a polarity signal; a power supply selecting device to switch a power supply supplied to the memory device based on a switching of the logic of the polarity signal; and a reading device to switch a read of logic stored in the memory device based on the switching of the logic of the polarity signal, and supplying the pixel electrodes.

With the electro-optic apparatus according to an aspect of the present invention, the memory is supplied by the power supply selecting device with a power supply that is switched based on switches in the logic of the polarity signal. At the same time, a read of the logic stored in the memory device by the reading device is switched and the read logic is supplied to the pixel electrodes. In response to a switch in the logic of the polarity signal, a potential with inverted polarity for the same tone is supplied to a pixel electrode. By doing so, while setting and holding the predetermined potential at the counter electrode constant, the electric field between the pixel electrode and the counter electrode is switched based on the polarity signal, thereby realizing an AC driving of the electro-optic material. At that time, there is no need to invert the polarity of the counter electrodes that have a large load capacity, so that the occurrence of a peak current when the polarity is switched is suppressed and it is possible to use a power supply whose driving capacity is reduced by a corresponding amount. Power consumption is in turn reduced in keeping with the reduction in the driving capacity of the power supply.

According to one aspect of an electro-optic apparatus of the present invention, the power supply selecting device selects, in accordance with the logic of the polarity signal, one pair of potentials for the logic of the memory device out of a first pair and a second pair and supplies the memory device with the selected potentials.

With this aspect, an extremely simple construction where the power supply selecting device selects, in accordance with the logic of the polarity signal, one pair of potentials for the logic of the memory device out of a first pair and a second pair and supplies the memory device with the selected potentials is used.

According to another aspect of an electro-optic apparatus of the present invention, the electro-optic apparatus further includes a tone power supply selecting device that selects, in accordance with the logic of the polarity signal, one pair of potentials for tones of the data signal supplied to the pixel electrodes, out of a first pair and a second pair.

With this aspect, the data signal supplied to the pixel electrodes is set at a potential by an extremely simple construction that selects a pair of potentials for each tone out of a first pair and a second pair in accordance with the logic of the polarity signal.

According to another aspect of an electro-optic apparatus of the present invention, one potential in the respective pairs of potentials for tones in the data signal supplied to the pixel electrodes is set at the counter electrode potential.

With this aspect, one of the potentials for tones in the respective pairs that is supplied to the pixel electrodes is set at the same predetermined potential (counter electrode potential) as the counter electrode, so that the construction to supply power can be simplified by an amount corresponding to the reduction in the required types of potential.

According to another aspect of an electro-optic apparatus of the present invention, the electro-optic apparatus further includes: a control device to select one of moving picture mode and still picture mode as an operation mode; and a selection permitting device that prohibits supply of the data signal to the pixel electrodes in accordance with a selection of the scan lines when the still picture mode is selected by the control device. When the still picture mode is selected by the control device, the tone power supply selecting device does not select the potentials of the respective tones of the data signal in accordance with the logic of the polarity signal.

With this aspect, when the still picture mode is selected by the control device, the tone power supply selecting device does not select the potentials of the respective tones of the data signal in accordance with the logic of the polarity signal, so that the driving for this selection operation becomes unnecessary and the power consumption is reduced.

According to another aspect of an electro-optic apparatus of the present invention, the electro-optic apparatus further includes a polarity signal processing device to supply, when the still picture mode is selected by the control device, the power supply selecting device and the reading device with a polarity signal in accordance with a selection of the scan lines, and holding the polarity signal and supplying the power supply selecting device and reading device with the held polarity signal in accordance with an unselection of the scan lines.

With this aspect, in the still picture mode, the supplying of the polarity signal to the power supply selecting device and the reading device and the holding of the polarity signal is switched in accordance with the selection/unselection of the scan lines. Accordingly, when the polarity signal is inverted for every single frame, for example, a polarity signal with inverted logic is supplied in accordance with the successive selection of the scan lines and is held after selection, so that the AC driving of the electro-optic material is realized. By doing so, in the still picture mode, the construction to supply the polarity signal to the power supply selecting device and the reading device and holding the polarity signal is simplified.

According to another aspect of an electro-optic apparatus of the present invention, the scan lines are successively selected one line at a time, and the polarity is successively inverted by the polarity signal processing device. When the still picture mode is selected by the control device, a selection period of the scan lines is set longer than a selection period of the scan lines when the moving picture mode is selected. At this time, the scan line driving circuit functions as a polarity inverting circuit.

With this aspect, when the still picture mode is selected by the control device, the power consumption for the selection operation of scan lines is reduced by an amount corresponding to the longer setting of the selection period of the scan lines.

A driving method for an electro-optic apparatus according to an aspect of the present invention is a driving method for an electro-optic apparatus including a plurality of scan lines, a plurality of data lines that intersect the scan lines, pixel electrodes disposed at respective intersections of the scan lines and the data lines, counter electrodes disposed opposite the pixel electrodes, electro-optic material disposed between the respective pixel electrodes and the respective counter electrodes, and memory to store logic corresponding to a tone of a data signal supplied from the data lines, the driving method including: setting the counter electrodes at a predetermined potential; and switching the power supply supplied to the memory based on logic of a polarity signal and switching a read of logic stored in the memory based on a switch of the logic of the polarity signal.

With the driving method for an electro-optic apparatus according to an aspect of the present invention, the power supply is switched and supplied to the memory based on a switch of the logic of the polarity signal. At the same time, the read of logic stored by the memory is switched and the read logic is supplied to the pixel electrodes. That is, in response to a switching of the logic of the polarity signal, inverted potentials for the same tones are supplied to the pixel electrodes. By doing so, while setting and holding the predetermined potential at the counter electrode constant, the electric field between the pixel electrode and the counter electrode is switched based on the polarity signal, thereby realizing an AC driving of the electro-optic material. At that time, there is no need to invert the polarity of the counter electrodes which have a large load capacity, so that the occurrence of a peak current when the polarity is switched is suppressed and it is possible to use a power supply whose driving capacity is reduced by a corresponding amount. Power consumption is also reduced in keeping with the reduction in the driving capacity of the power supply.

An electronic appliance according to an aspect of the present invention includes the electro-optic apparatus described above (including the various aspects).

With this electronic appliance according to an aspect of the present invention, display of images can be realized with reduced power consumption.

DETAILED DESCRIPTION OF EXEMPLARY EMBODIMENTS

First Exemplary Embodiment

A first exemplary embodiment where the present invention has been applied to a liquid crystal display apparatus will now be described with reference to the drawings.

Figure 1:
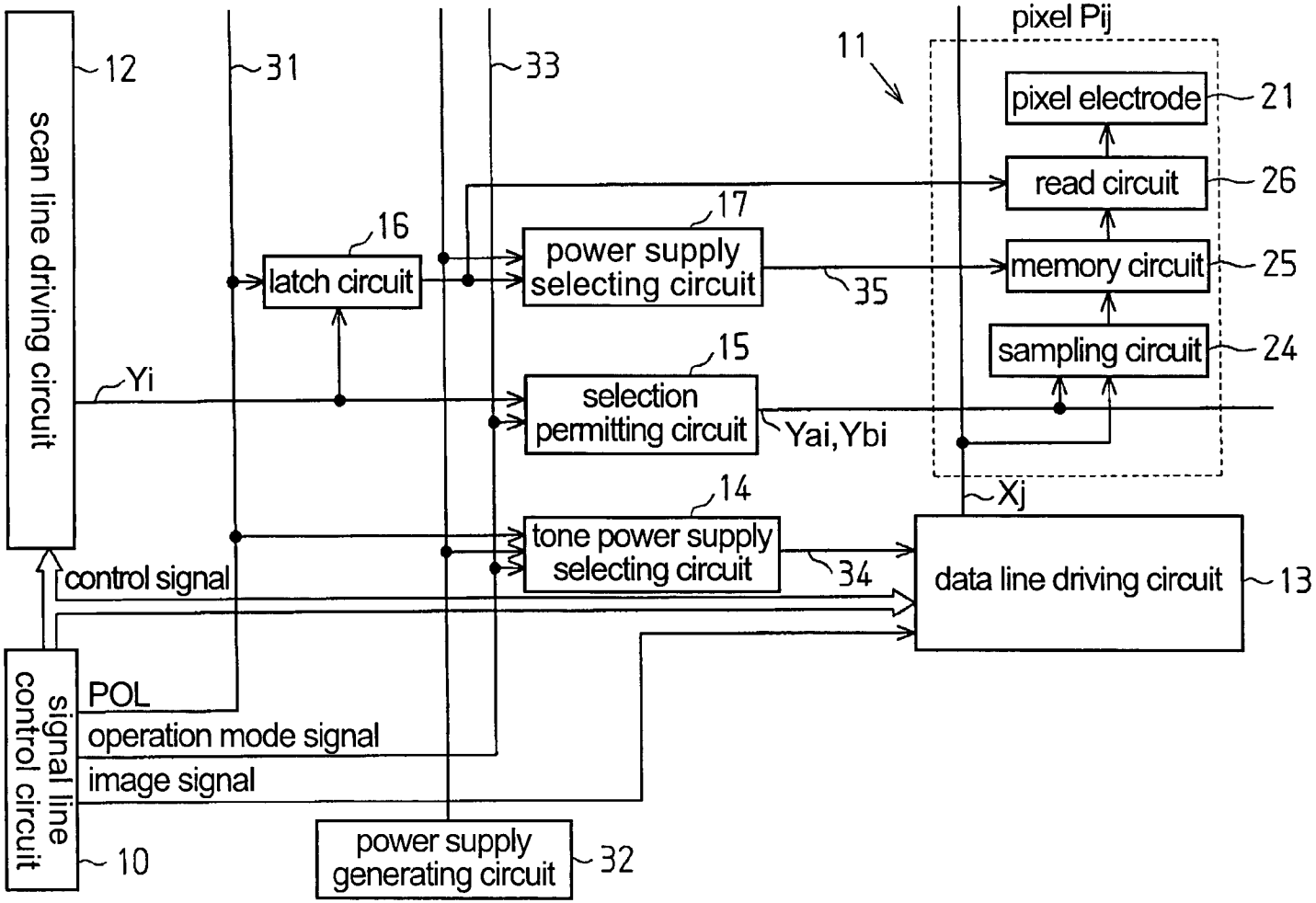
FIG. 1 is a schematic showing a first exemplary embodiment of the present invention.

FIG. 1 is a schematic showing the electrical construction of a liquid crystal display apparatus according to the present exemplary embodiment. As shown in FIG. 1, this liquid crystal display apparatus is equipped with a signal line control circuit 10, a liquid crystal panel 11, a scan line driving circuit 12, a data line driving circuit 13, and a tone power supply selecting circuit 14 that selectively supplies a power supply voltage, described later, to the data line driving circuit 13.

The liquid crystal panel 11 is equipped with a plurality of scan lines Yi (where i is a natural number in a range of 1 to n) that are connected to one end of the scan line driving circuit 12 and a plurality of data lines Xj (where j is a natural number in a range of 1 to m) that are connected to one end of the data line driving circuit 13 and intersect the scan lines Yi. Each of the scan lines Yi is respectively provided with a selection permitting circuit 15, a latch circuit 16, and a power supply selecting circuit 17. Also, on the liquid crystal panel 11, respective pixels Pij are formed at intersections between the scan lines Yi and the data lines Xj.

It should be noted that in FIG. 1, one scan line Yi, one data line Xj, and one pixel Pij are shown out of the liquid crystal panel 11 as representatives. There are in fact a number (n×m) of pixels Pij corresponding to the number (n) of scan lines and the number (m) of data lines. Each pixel Pij is equipped with a pixel electrode 21, a sampling circuit 24, a memory circuit 25, and a read circuit 26. The data line Xj is connected via the sampling circuit 24, the memory circuit 25, and the read circuit 26, to the pixel electrode 21.

The scan line driving circuit 12 is connected to the signal line control circuit 10 and receives an input of various control signals. The scan line driving circuit 12 outputs, to the scan lines Yi, scan signals to successively select one, out of the plurality of scan lines Yi, based on a control signal from the signal line control circuit 10. The scan signal on a scan line Yi is set at a high level during a selected period for the present scan line Yi and at a low level during an unselected period.

The data line driving circuit 13 is connected to the signal line control circuit 10 and receives an input of various control signals and an image signal. Based on the control signals from the signal line control circuit 10, the data line driving circuit 13 outputs data signals corresponding to the image signal to the respective data lines Xj.

Figure 2:
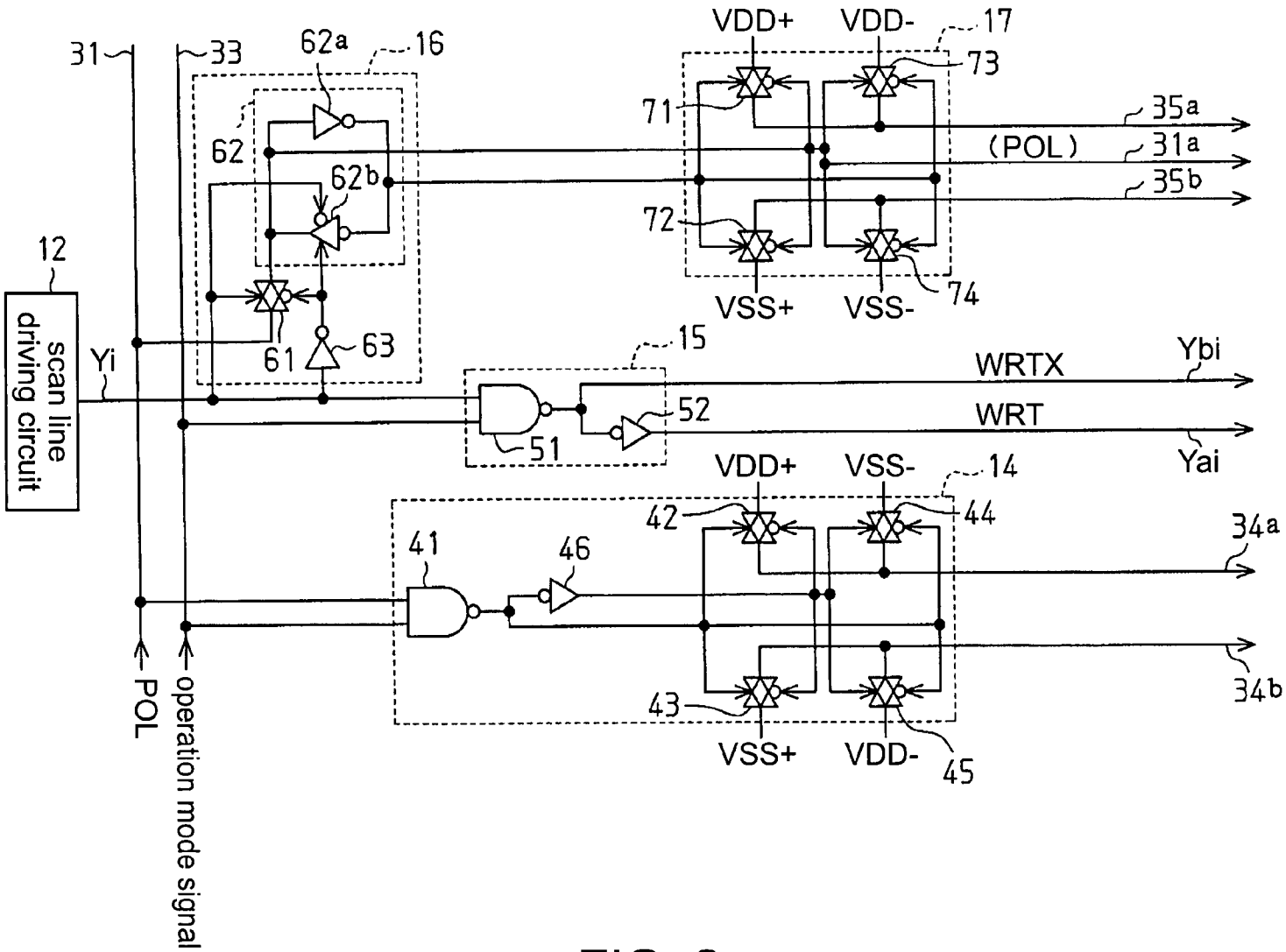
FIG. 2 is an electrical circuit schematic of the same exemplary embodiment.

FIG. 2 is an electrical circuit schematic showing the detailed construction of the liquid crystal display apparatus. Components, such as the tone power supply selecting circuit 14, the selection permitting circuit 15, the latch circuit 16, and the power supply selecting circuit 17 mentioned above will now be described in detail with reference to FIG. 2.

The tone power supply selecting circuit 14 is connected to the signal line control circuit 10 via a polarity line 31 and is supplied, via the polarity line 31, with a polarity signal POL whose polarity is cyclically and repeatedly inverted. The tone power supply selecting circuit 14 is also connected to a power supply generating circuit 32 and is supplied with power supply voltages with a plurality of different potentials (in the present exemplary embodiment, four potentials). In addition, the tone power supply selecting circuit 14 is connected to the signal line control circuit 10 via an operation mode signal line 33 and is supplied via the operation mode signal line 33 with an operation mode signal with a level that corresponds to an operation mode for images. This operation mode signal is set at a high level when the operation mode is moving picture mode and at a low level when the operation mode is still picture mode.

The tone power supply selecting circuit 14 is connected to the data line driving circuit 13 via a tone power supply line 34. When the operation mode signal is at the high level (moving picture mode), power supply voltages with a pair (two) of potentials for black and white that have been selected according to the level (polarity) of the polarity signal POL are supplied to the data line driving circuit 13. The data line driving circuit 13 samples the image signal based on a control signal from the signal line control circuit 10 and, in accordance with the result of the sampling, outputs a power supply voltage with a potential for black or white out of the selected pair to a data line Xj as a data signal. That is, the power supply voltages (data signals) with potentials for black and white that are outputted to the data lines Xj are switched in accordance with the level of the polarity signal POL.

In more detail, as shown in FIG. 2, the tone power supply selecting circuit 14 is equipped with a NAND circuit 41, and analog switches 42, 43, 44, 45 to which power supply voltages with the respective potentials VDD+, VSS+, VSS−, and VDD− from the power supply generating circuit 32 are applied. The analog switches 42, 44 are connected to the data line driving circuit 13 via a black display power supply line 34*a* of the tone power supply line 34, while the analog switches 43, 45 are connected to the data line driving circuit 13 via a white display power supply line 34*b* of the tone power supply line 34.

One input terminal of the NAND circuit 41 is connected to the polarity line 31, while another input terminal is connected to the operation mode signal line 33. An output terminal of the NAND circuit 41 is connected to the analog switches 42 to 45 and is also connected to the same analog switches 42 to 45 via an inverter 46. If a polarity signal POL at the low level is supplied when the operation mode signal is at the high level, the analog switches 42, 43 are turned on by a signal with a high level outputted from the output terminal of the NAND circuit 41. By doing so, a power supply voltage with the potential VDD+is supplied to the data line driving circuit 13 via the black display power supply line 34*a* mentioned above and a power supply voltage with the potential VSS+ is supplied to the data line driving circuit 13 via the white display power supply line 34*b*. Next, based on the image signal, the data line driving circuit 13 outputs the power supply voltage with the potential VDD+ for black or the power supply voltage with the potential VSS+ for white as a data signal to a data line Xj.

If a polarity signal POL at the high level is supplied when the operation mode signal is at the high level, the analog switches 44, 45 are turned on by a signal with a low level output from the output terminal of the NAND circuit 41. By doing so, a power supply voltage with the potential VSS− is supplied to the data line driving circuit 13 via the black display power supply line 34*a* mentioned above. A power supply voltage with the potential VDD− is supplied to the data line driving circuit 13 via the white display power supply line 34*b*. Next, based on the image signal mentioned above, the data line driving circuit 13 outputs the power supply voltage with the potential VSS− for black or the power supply voltage with the potential VDD− for white as a data signal to a data line Xj.

It should be noted that when the operation mode signal is at the low level, regardless of the level (high level or low level) of the supplied polarity signal POL, a signal at the high level is outputted from the output terminal of the NAND circuit 41 and the analog switches 42, 43 are turned on. By doing so, a power supply voltage with the potential VDD+ is supplied to the data line driving circuit 13 via the black display power supply line 34*a*. A power supply voltage with the potential VSS+ is supplied to the data line driving circuit 13 via the white display power supply line 34*b*.

The selection permitting circuit 15 mentioned above is connected to the scan line driving circuit 12 via a scan line Yi. The scan line driving circuit 12 outputs, to the selection permitting circuit 15 of a scan line Yi, a scan signal with a high level potential and a low level potential respectively corresponding to a selection/unselection of that scan line Yi. The selection permitting circuit 15 is also connected via the operation mode signal line 33 to the signal line control circuit 10 and is supplied with the operation mode signal. Additionally, the selection permitting circuit 15 is connected to the sampling circuits 24 of pixels Pij via a scan line pair Yai, Ybi of the scan line Yi. When supplied with a scan signal and operation mode signal at the high level, the selection permitting circuit 15 turns on the sampling circuits 24 to supply the pixel electrodes 21 of the pixels Pij on the present scan line Yi with the data signal outputted to the data Xj.

In more detail, as shown in FIG. 2, the selection permitting circuit 15 is equipped with a NAND circuit 51, one input terminal of which is connected to the scan line Yi and another input terminal of which is connected to the operation mode signal line 33. An output terminal of the NAND circuit 51 is connected to one scan line Yai via an inverter 52 and is also directly connected to another scan line Ybi. Accordingly, when the operation mode signal is at the high level (moving picture mode), if a high level scan signal is supplied (this corresponds to the selected state), a low level signal is output from the output terminal of the NAND circuit 51. As a result, a scan signal WRT at the high level is supplied to one of the scan lines Yai via the inverter 52. An inverted signal WRTX at the low level is supplied to the other scan line Ybi. The sampling circuits 24 connected to these scan lines Yai, Ybi are turned on. The data signal with a potential corresponding to the image signal is then supplied, via the data line Xj, to the pixel electrodes 21 of the pixels Pij on the present scan line Yi, and the data signal is read into the pixel electrodes 21.

It should be noted that when the operation mode signal is at the high level (moving picture mode), if a high level scan signal is supplied (this corresponds to the unselected state), a high level signal is output from the output terminal of the NAND circuit 51. As a result, when a scan signal WRT at the low level is supplied to one of the scan lines Yai via the inverter 52, an inverted signal WRTX at the high level is supplied to the other scan line Ybi, and the sampling circuits 24 connected to these scan lines Yai, Ybi are turned off. Accordingly, a data signal is not supplied to the pixel electrodes 21 of the pixels on the present scan line Yi.

In the same way, when the operation mode signal is at the low level (still picture mode), regardless of the level (high level or low level) of the supplied scan signal, a signal at the high level is output from the output terminal of the NAND circuit 51. As a result, in accordance with the above, the sampling circuits 24 are turned off and a data signal is not supplied to the pixel electrode 21 of any of the pixels Pij.

The latch circuit 16 is connected to the scan line driving circuit 12 via a scan line Yi and is supplied with a scan signal. The latch circuit 16 is also connected to the signal line control circuit 10 via the polarity line 31, and is supplied with the polarity signal POL. Additionally, the latch circuit 16 is connected to the read circuits 26 of the pixels Pij and the power supply selecting circuit 17 on the present scan line Yi. When supplied with a scan signal at the high level, the latch circuit 16 outputs the polarity signal POL to the power supply selecting circuit 17 and the read circuits 26. When supplied with a scan signal at the low level, the latch circuit 16 holds the polarity signal POL immediately before the switch to the low level and outputs the held polarity signal POL to the power supply selecting circuit 17 and the read circuits 26.

In more detail, as shown in FIG. 2, the latch circuit 16 is equipped with an analog switch 61 connected to the polarity line 31 and a memory circuit part 62 constructed of two inverters 62*a*, 62*b*. The analog switch 61 is connected to the scan line Yi and is turned on when supplied with a scan signal at the high level and an inverted signal for the scan signal via the inverter 63. The analog switch 61 is turned off when supplied with a scan signal at the low level and an inverted signal for the scan signal via the inverter 63.

The memory circuit part 62 is connected to the analog switch 61. That is, an input terminal of the inverter 62*a* and an output terminal of the inverter 62*b* are connected to the analog switch 61. In addition, power supply terminals of the other inverter 62*b* are respectively connected directly to the scan line Yi and via the inverter 63 to the scan line Yi. The inverter 62*b* becomes inactive (a non-active state) when a scan signal at the high level and an inverted signal for such a scan signal provided via the inverter 63, are input. The inverter 62*b* becomes active (an active state) when a scan signal at the low level and an inverted signal for such a scan signal provided via the inverter 63, are input. Accordingly, a state where the analog switch 61 is on and supplies the polarity signal POL and a state where data (the level of the polarity signal POL) is held by the memory circuit part 62 are produced mutually exclusively.

The output terminals of the analog switch 61 and the inverter 62*b* are connected to the power supply selecting circuit 17, and the output terminal of the inverter 62*a* is connected to the power supply selecting circuit 17. Accordingly, when a scan signal at the high level is supplied to the present scan line Yi, the analog switch 61 is turned on and the polarity signal POL is supplied to the power supply selecting circuit 17, with an inverted signal for this polarity signal POL also being supplied to the power supply selecting circuit 17. Also, when a scan signal at the low level is supplied to the present scan line Yi, the analog switch 61 is turned off, the polarity signal POL is cut off, and the inverter 62*b* is placed in the active state. As a result, the memory circuit part 62 holds the level (polarity) of the polarity signal POL immediately before the scan signal switched to the low level. The signal whose level is held, is supplied to the power supply selecting circuit 17. An inverted signal for this signal is supplied via the inverter 62*a* to the power supply selecting circuit 17.

Figure 3:
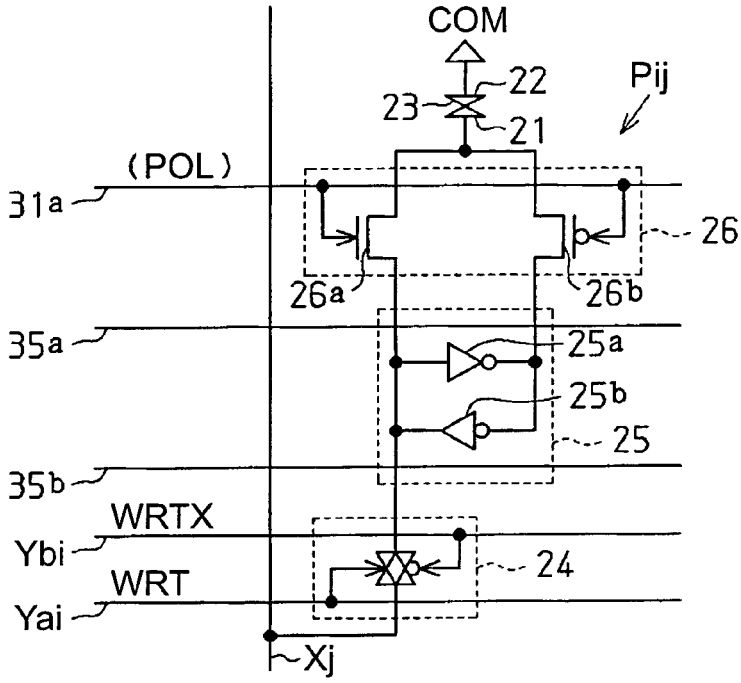
FIG. 3 is an electrical circuit schematic of the same exemplary embodiment.

It should be noted that the output terminals of the analog switch 61 and the inverter 62*b* are connected via a polarity line 31*a* to the read circuits 26 (see FIG. 3). Accordingly, when a scan signal at the high level is supplied to the present scan line Yi, the analog switch 61 is turned on and the polarity signal POL is supplied via the polarity line 31*a* to the read circuits 26. Also, when a scan signal at the low level is supplied to the present scan line Yi, the analog switch 61 is turned off, the polarity signal POL is cut off, and the inverter 62*b* is placed in the active state. As a result, the memory circuit part 62 holds the level (polarity) of the polarity signal POL immediately before the scan signal switched to the low level. The signal whose level is held is then supplied to the read circuits 26.

The power supply selecting circuit 17 mentioned above is connected to the latch circuit 16 and is supplied, via the latch circuit 16 (the analog switch 61), with the polarity signal POL and an inverted signal for the same, or a signal held by the latch circuit 16 (the memory circuit part 62) and an inverted signal for the same. The power supply selecting circuit 17 is also connected to the power supply generating circuit 32 and is supplied with power supply voltages with a plurality (four) of different potentials. The power supply selecting circuit 17 is also connected via a power supply line 35 to the memory circuits 25 of the pixels Pij. The power supply selecting circuit 17 supplies the memory circuits 25 with a power supply voltage with a pair (two) of potentials for a high level (plus side) and a low level (minus side) selected in accordance with either the level of the polarity signal POL received via the latch circuit 16 or the level of the signal held by the latch circuit 16.

In more detail, as shown in FIG. 2, the power supply selecting circuit 17 is equipped with analog switches 71, 72, 73, 74 to which power supply voltages with the respective potentials VDD+, VSS+, VDD−, VSS− are applied by the power supply generating circuit 32. In addition, the analog switches 71 to 74 are connected to the output terminals of the analog switch 61 and the inverter 62*b* and are also connected to the output terminal of the inverter 62*a*. The analog switches 71, 73 are connected via a plus power supply line 35*a* of the power supply line 35 to the memory circuits 25, while the analog switches 72, 74 are connected via a minus power supply line 35*b* of the power supply line 35 to the memory circuits 25 (see FIG. 3).

The analog switches 71, 72 are turned on when the polarity signal POL supplied via the analog switch 61 is at the low level (when the output terminal of the inverter 62*a* is at the high level). The analog switches 71, 72 are also turned on when the signal held by the memory circuit part 62 is at the low level at the output terminal of the inverter 62*b* (when the output terminal of the inverter 62*a* is at the high level). As a result, a power supply voltage with the potential VDD+ is supplied via the plus power supply line 35*a* to the memory circuits 25 and a power supply voltage with the potential VSS+ is supplied via the minus power supply line 35*b* to the memory circuits 25. The analog switches 73, 74 are turned on when the polarity signal POL supplied via the analog switch 61 is at the high level (when the output terminal of the inverter 62*a* is at the low level). The analog switches 73, 74 are also turned on when the signal held by the memory circuit part 62 is at the high level at the output terminal of the inverter 62*b* (when the output terminal of the inverter 62*a* is at the low level). As a result, a power supply voltage with the potential VDD− is supplied via the plus power supply line 35*a* to the memory circuits 25 and a power supply voltage with the potential VSS− is supplied via the minus power supply line 35*b* to the memory circuits 25. By operating in this way, power supply voltages with the respective high level potential and low level potential in one selected pair, are supplied to the memory circuits 25. It should be noted that it is necessary to consider the response to a change in the power supply voltage when logic is being held by the memory circuit 25. In more detail, out of the power supply potentials supplied to the memory circuits 25 during the response (during a transition in power supply potential), the higher potential may always be kept higher than the lower potential. If this potential relationship is reversed (or if the potential difference approaches a vicinity of a threshold value of a TFT), there can potentially be a breakdown in the memory logic.

For this reason, the performance of the analog switch 71 may be higher than that of the analog switch 72. In the same way, the performance of the analog switch 74 may be higher than that of the analog switch 73. With this construction, when switching to the plus-side power supply, the performance of the analog switch 71 is higher than that of the analog switch 72 so that the transition to VDD+ is faster than the transition to VSS+. In the same way, when switching to the minus-side power supply, the performance of the analog switch 73 is higher than that of the analog switch 74 so that the transition to VSS− is faster than the transition to VDD−.

FIG. 3 is a circuit schematic showing the respective pixels Pij according to the present exemplary embodiment. As shown in FIG. 3, in each pixel Pij, a liquid crystal volume element 23 is formed by sandwiching (disposing inside) liquid crystals between the pixel electrode 21 and the counter electrode 22 as an electro-optic material. The counter electrode signal COM with a predetermined voltage (VC) that is common to every pixel is supplied to this counter electrode 22.

The sampling circuit 24 of the pixel Pij is composed of an analog switch and is connected to the scan line pair Yai, Ybi. As described above, if the sampling circuit 24 is supplied with a scan signal at the high level when the operation mode signal is at the high level (moving picture mode), a scan signal WRT at the high level is supplied to one scan line Yai, an inverted signal WRTX for the scan signal WRT at the low level is supplied to the other scan line Ybi, and the sampling circuit 24 is turned on. The data signal from the data line Xj is then supplied to the memory circuit 25.

The memory circuit 25 is composed of two inverters 25*a*, 25*b* and, as described above, is supplied by two power supply lines 35*a*, 35*b* respectively for the plus side and the minus side. Accordingly, the logic stored in the memory circuit 25 has a potential that is supplied from the plus power supply line 35*a* corresponding to the high level and a potential that is supplied from the minus power supply line 35*b* corresponding to the low level.

The memory circuit 25 is connected to the sampling circuit 24 and the read circuit 26, and outputs, when the sampling circuit 24 is on (a state where a high level scan signal is supplied when the operation mode signal is at the high level), the data signal from the data line Xj to the read circuit 26.

When the sampling circuit 24 is off, the memory circuit 25 holds the logic (i.e., the level of the data signal) immediately before the sampling circuit 24 was switched off and outputs the held logic to the read circuit 26. That is, in the memory circuit 25, the respective output terminals of the inverters 25*a*, 25*b* are connected to the read circuit 26 and output a high level and a low level potential corresponding to the held logic to the read circuit 26. It should be obvious that the high level and low level potentials corresponding to the logic held by the memory circuit 25 are the pair of plus and minus potentials of the power supply voltage supplied from the power supply selecting circuit 17 in accordance with the polarity signal POL immediately before the sampling circuit 24 (and the analog switch 61) was turned off.

The read circuit 26 is composed of an N-channel TFT 26*a* and a P-channel TFT 26*b*, with the respective sources of these TFTs being connected to the memory circuit 25 and the sampling circuit 24 and the respective drains being connected to the pixel electrode 21.

The source of the N-channel TFT 26*a* is connected to the output terminals of the sampling circuit 24 and the inverter 25*b* and the source of the P-channel TFT 26*b* is connected to the output terminals of the sampling circuit 24 and the inverter 25*b*. The respective gates of the TFTs are connected via the polarity line 31*a* to the output terminals of the analog switch 61 and the inverter 62*b* of the latch circuit 16. The respective gates of the N-channel TFT 26*a* and the P-channel TFT 26*b* are supplied with the polarity signal POL that has passed the analog switch 61 or a signal of the output terminal of the inverter 62*b* that is held by the memory circuit part 62. Accordingly, one of the N-channel TFT 26*a* and the P-channel TFT 26*b* is turned on in accordance with the level (polarity) of the signal supplied to the respective gates.

When the signal supplied to the respective gates of the N-channel TFT 26*a* and the P-channel TFT 26*b* is at the high level, the N-channel TFT 26*a* is turned on and the potential of a data signal that has passed the sampling circuit 24 or the potential of an output terminal of the inverter 25*b* held by the memory circuit 25 is supplied to the pixel electrode 21. When the signal supplied to the respective gates of the N-channel TFT 26*a* and the P-channel TFT 26*b* is at the low level, the P-channel TFT 26*b* is turned on and the potential of a data signal that has passed the sampling circuit 24 or the potential of an output terminal of the inverter 251 held by the memory circuit 25 is supplied to the pixel electrode 21.

Figure 4:
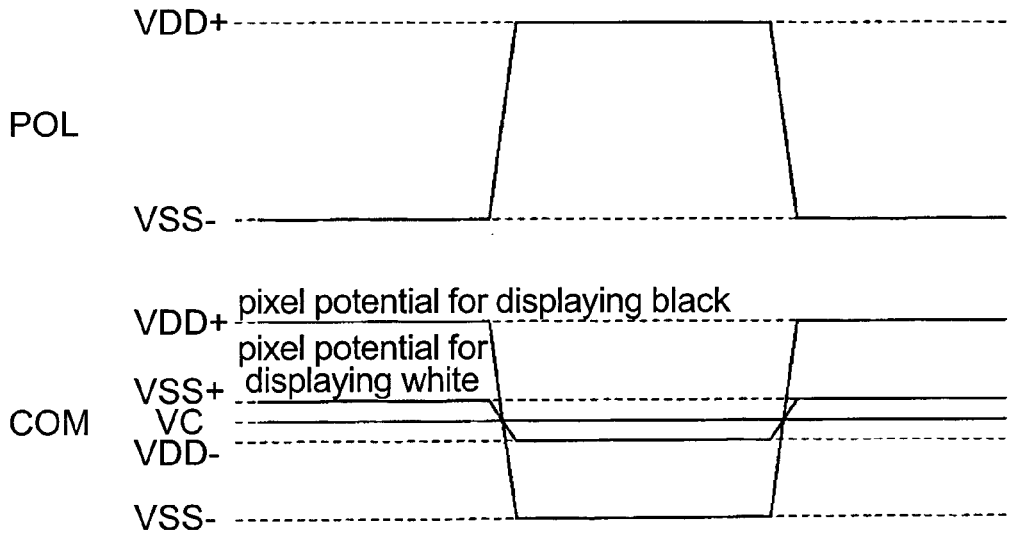
FIG. 4 is a timing chart showing how the same exemplary embodiment is driven.

FIG. 4 is a timing chart showing how the liquid crystal display apparatus according to the present exemplary embodiment is driven. The operation when the respective pixels are driven will now be described with reference to FIG. 4.

It should be noted that in the present exemplary embodiment the polarity signal POL is reversed at frame intervals and based on this, a plus polarity signal and a minus polarity signal are alternately written into the pixel electrode 21. Specifically, the liquid crystals are driven with AC according to a voltage-inverting driving method. Accordingly, the supplying of the data signal, for example, is carried out in accordance with a polarity signal POL with the same polarity for every pixel Pij.

As shown in FIG. 4, the relationship between the potentials VDD+, VSS+, VDD−, VSS− of the power supply voltages supplied by the power supply generating circuit 32 mentioned above can be expressed as VDD+>VSS+>VDD−>VSS−. The potential VC of the counter electrode signal COM supplied to the counter electrode 22 is a potential between the potentials VSS+ and VDD−. A voltage between the potentials VSS+ and VC and a voltage between the potentials VC and VDD− are set as equal. Also, a voltage between the potentials VDD+ and VC and a voltage between the potentials VC and VSS− are set as equal. In the present exemplary embodiment, the magnitudes of the respective voltages between the potentials VDD+ and VC and between the potentials VC and VSS− corresponding to a display of black are set larger than the magnitudes of the respective voltages between the potentials VSS+ and VC and between the potentials VC and VDD− corresponding to a display of white. That is, in the present exemplary embodiment, a so-called "normally white mode" is used where a larger electric field is applied to the liquid crystals corresponding to a display of black. It should be obvious that by inverting the magnitude relationship for the electric field applied to the liquid crystals according to the tone, it is possible to replace this with a "normally black mode". In addition, the potential of the low level of the polarity signal POL is set at the potential VSS−, and the potential of the high level is set at the potential VDD+. These values are used to set a sufficiently high potential to turn on the N-channel TFT 26*a* and the P-channel TFT 26*b* and rewriting the logic held in the memory circuit 25.

Here, the operation of the liquid crystal display apparatus will be described for a case where the operation mode signal is at the high level (moving picture mode) and a scan signal with the high level potential is supplied to the scan line Yi (the selected state for the scan line Yi). At this time, the sampling circuits 24 are turned on, the data signal from the data line Xj is supplied to the pixel electrodes 21 on the present scan line Yi, the analog switch 61 of the latch circuit 16 is also turned on, and the polarity signal POL is outputted to the read circuits 26 (the respective gates of the N-channel TFTs 26*a* and the P-channel TFTs 26*b*).

At this time, if the polarity signal POL is at the low level, as shown in FIG. 4, the tone power supply selecting circuit 14 supplies the data line driving circuit 13 with a power supply voltage including the potentials VDD+, VSS+ for displaying black and displaying white. Accordingly, based on the image signal, the data line driving circuit 13 outputs a data signal with the potential VDD+ for displaying black or a data signal with the potential VSS+ for displaying white to the data line Xj. Also, the power supply selecting circuit 17 supplies a power supply voltage with the plus and minus potentials VDD+, VSS+ to the memory circuits 25. Additionally, the respective gates of the N-channel TFTs 26*a* and the P-channel TFTs 26*b* are supplied via the analog switch 61 of the latch circuit 16 with the polarity signal POL with the low level potential VSS−. By doing so, the P-channel TFTs 26*b* are turned on and a data signal is supplied to the pixel electrodes 21 from the data line Xj.

For example, suppose that the data line scanning circuit 13 has output a data signal with the potential VDD+ for displaying black to the data line Xj. At this time, the pixel electrode 21 is set via the P-channel TFT 26*b* at the potential VDD+, and a voltage of between VDD+ and VC for displaying black is applied between the pixel electrode 21 and the counter electrode 22. A display state (black display) in accordance with this applied voltage is then shown by the present pixel Pij. Suppose that the data line scanning circuit 13 has output a data signal with the potential VSS+ for displaying white to the data line Xj. At this time, the pixel electrode 21 is set via the P-channel TFT 26*b* at the potential VSS+, and a voltage of between VSS+ and VC for displaying white is applied between the pixel electrode 21 and the counter electrode 22. A display state (white display) in accordance with this applied voltage is then shown by the present pixel Pij.

If the polarity signal POL is at the high level, as shown in FIG. 4, the tone power supply selecting circuit 14 supplies the data line driving circuit 13 with a power supply voltage including the potentials VSS−, VDD− for displaying black and displaying white. Accordingly, based on the image signal, the data line driving circuit 13 outputs a data signal with the potential VSS− for displaying black or a data signal with the potential VDD− for displaying white to the data line Xj. Also, the power supply selecting circuit 17 supplies a power supply voltage with the plus and minus potentials VDD−, VSS− to the memory circuit 25. Additionally, the respective gates of the N-channel TFT 26*a* and the P-channel TFT 26*b* are supplied via the analog switch 61 of the latch circuit 16 with the polarity signal POL with the high level potential VDD+. By doing so, the N-channel TFT 26*a* is turned on and a data signal is supplied to the pixel electrode 21 from the data line Xj.

For example, suppose that the data line scanning circuit 13 has output a data signal with the potential VSS− for displaying black to the data line Xj. At this time, the pixel electrode 21 is set via the N-channel TFT 26*a* at the potential VSS−, and a voltage of between VSS− and VC for displaying black is applied between the pixel electrode 21 and the counter electrode 22. A display state (black display) in accordance with this applied voltage is then shown by the present pixel Pij. Suppose that the data line scanning circuit 13 has output a data signal with the potential VDD− for displaying white to the data line Xj. At this time, the pixel electrode 21 is set via the N-channel TFT 26*a* at the potential VDD−, and a voltage of between VDD− and VC for displaying white is applied between the pixel electrode 21 and the counter electrode 22. A display state (white display) in accordance with this applied voltage is then shown by the present pixel Pij.

Next, the operation of a liquid crystal display apparatus when the potential of the scan signal supplied to the scan line Yi has switched to the low level (when the scan line Yi is in the unselected state) will be described. At this time, the sampling circuit 24 is turned off so that the data line Xj is cut off. The analog switch 61 of the latch circuit 16 is turned off so that the polarity line 31 is cut off. The memory circuit part 62 holds the polarity of the polarity signal POL immediately before the scan signal is switched to the low level. By doing so, the power supply selecting circuit 17 continues to supply the memory circuit 25 with the power supply voltage with the plus and minus potentials corresponding to the polarity of the polarity signal POL immediately before the scan signal is switched to the low level, so that the memory circuit 25 holds the logic at that time. Additionally, in accordance with the polarity of the polarity signal POL immediately before the scan signal is switched to the low level, the N-channel TFT 26*a* or the P-channel TFT 26*b* is turned on. Accordingly, the pixel electrode 21 is held at the potential immediately before the scan signal is switched to the low level.

For example, suppose that the polarity signal POL, immediately before the scan signal is switched to the low level, is at the low level and that the pixel electrode 21 has a potential VDD+ for displaying black. In this state, if the scan signal switches to the low level, the logic is held by the memory circuit 25 and the output terminal of the inverter 25*a* has the high level potential VDD+ and the output terminal of the inverter 25*b* has the low level potential VSS+. Accordingly, the pixel electrode 21 is held at the potential VDD+ via the P-channel TFT 26*b*, and the voltage between the potentials VDD+, VC for displaying black continues to be applied between the pixel electrode 21 and the counter electrode 22. The present pixel Pij maintains a display state (a display of black) in accordance with the applied voltage. Suppose that the polarity signal POL immediately before the scan signal is switched to the low level is at the low level and that the pixel electrode 21 has a potential VSS+ for displaying white. In this state, if the scan signal switches to the low level, the logic is held by the memory circuit 25 and the output terminal of the inverter 25*a* has the low level potential VSS+ and the output terminal of the inverter 25*b* has the high level potential VDD+. Accordingly, the pixel electrode 21 is held at the potential VSS+via the P-channel TFT 26*b*. The voltage between the potentials VSS+, VC for displaying white continues to be applied between the pixel electrode 21 and the counter electrode 22. The present pixel Pij maintains a display state (a display of white) in accordance with the applied voltage.

Suppose that the polarity signal POL immediately before the scan signal is switched to the low level is at the high level and that the pixel electrode 21 has a potential VSS− for displaying black. In this state, if the scan signal switches to the low level, the logic is held by the memory circuit 25 and the output terminal of the inverter 25*a* has the high level potential VDD− and the output terminal of the inverter 25*b* has the low level potential VSS−. Accordingly, the pixel electrode 21 is held at the potential VSS− via the N-channel TFT 26*a*, and the voltage between the potentials VSS−, VC for displaying black continues to be applied between the pixel electrode 21 and the counter electrode 22. The present pixel Pij maintains a display state (a display of black) in accordance with the applied voltage. Suppose that the polarity signal POL, immediately before the scan signal is switched to the low level, is at the high level and that the pixel electrode 21 has a potential VDD− for displaying white. In this state, if the scan signal switches to the low level, the logic is held by the memory circuit 25 and the output terminal of the inverter 25*a* has the low level potential VSS− and the output terminal of the inverter 25*b* has the high level potential VDD−. Accordingly, the pixel electrode 21 is held at the potential VDD− via the N-channel TFT 26*a*. The voltage between the potentials VDD−, VC for displaying white continues to be applied between the pixel electrode 21 and the counter electrode 22. The present pixel Pij maintains a display state (a display of white) in accordance with the applied voltage.

It should be noted that when the operation mode signal is at the high level (moving picture mode), if the polarity signal POL is inverted at the end of one frame, the supplying of the data signal to the pixel electrode 21 and the holding of the potential of the pixel electrode 21 in accordance with the logic held by the memory circuit 25 are carried out in the same way as described above in accordance with this polarity.

Next, the operation of the liquid crystal display apparatus will be described for a case where the operation mode signal is at the low level (still picture mode) and predetermined logic is held by the memory circuit 25. For example, suppose that the polarity signal POL has switched from the low level to the high level and the pixel electrode 21 is being held via the P-channel TFT 26*b* at the potential VDD+ for displaying black. At this time, if the scan signal at the high level is supplied to the scan line Yi, the analog switch 61 is turned on and a polarity signal POL at the high level is supplied. The power supply selecting circuit 17 then switches to a power supply voltage with the plus and minus potentials VDD−, VSS− and supplies this voltage to the memory circuit 25. Accordingly, corresponding to the logic held by the memory circuit 25, the output terminal of the inverter 25*a* is switched from the potential VDD+ to the potential VDD− and the output terminal of the inverter 25*b* is switched from the potential VSS+ to the potential VSS−. At the same time, the respective gates of the N-channel TFT 26*a* and the P-channel TFT 26*b* are supplied, via the analog switch 61 of the latch circuit 16, with a polarity signal POL at the high level. As a result, the N-channel TFT 26*a* is turned on and the pixel electrode 21 is switched via the N-channel TFT 26*a* to the potential VSS−, so that a voltage of between the potentials VSS- and VC for displaying black is applied between the pixel electrode 21 and the counter electrode 22. Based on the switched voltages applied across the electrodes of the present pixel Pij, the pixel Pij maintains the same display state (display of black).

Suppose that the polarity signal POL has switched from the low level to the high level and the pixel electrode 21 is being held via the P-channel TFT 26*b* at the potential VSS+ for displaying white. At this time, if the scan signal at the high level is supplied to the scan line Yi, the analog switch 61 is turned on and a polarity signal POL at the high level is supplied. The power supply selecting circuit 17 then switches to a power supply voltage with the plus and minus potentials VDD−, VSS− and supplies this voltage to the memory circuit 25. Accordingly, corresponding to the logic held by the memory circuit 25, the output terminal of the inverter 25*a* is switched from the potential VSS+ to the potential VSS− and the output terminal of the inverter 25*b* is switched from the potential VDD+ to the potential VDD−. At the same time, the respective gates of the N-channel TFT 26*a* and the P-channel TFT 26*b* are supplied, via the analog switch 61 of the latch circuit 16, with a polarity signal POL at the high level. As a result, the N-channel TFT 26*a* is turned on and the pixel electrode 21 is switched via the N-channel TFT 26*a* to the potential VDD−, so that a voltage of between the potentials VDD− and VC for displaying white is applied between the pixel electrode 21 and the counter electrode 22. Based on the switched voltages applied across the electrodes of the present pixel Pij, the pixel Pij maintains the same display state (display of white).

Even if the polarity signal POL is switched from the high level to the low level in the still picture mode, the display state is maintained based on the applied voltage whose polarity has switched in accordance with the above. If the scan signal switches to the low level, the analog switch 61 is turned off and the polarity of the polarity signal POL immediately before the switch is held by the memory circuit part 62 in the same way as described above.

It should be noted that when the operation mode signal is at the low level (still picture mode), regardless of the polarity of the polarity signal POL, the tone power supply selecting circuit 14 does not select (switch) the respective potentials for displaying black and for displaying white. The reason for this is that as there is no write operation, there is no need to select the potential of the data signal. Also, regardless of the scan signal from the scan line driving circuit 12, the sampling circuit 24 is turned off by the sampling circuit 24. The reason for this is that as there is no write operation, there is no need to input a data signal.

The above means that in the still picture mode, by outputting scan signals to the scan lines Yi, only the latch circuit 16 and the power supply selecting circuit 17 on the present scan line Yi operate. Accordingly, in the still picture mode, the scan line driving circuit 12 functions as a polarity sampling circuit.

When, as a result of this polarity sampling, the polarity (logic) of the polarity signal POL that has passed the latch circuit 16 changes, the logic of the power supply selecting circuit 17 and the read circuit 26 also changes. A transition occurs approximately simultaneously in the respective plus and minus potentials of the power supply selecting circuit 17, so that with the logic of the memory circuit 25 continuing to be held, a switch is carried out to potentials corresponding to the held logic.

At the same time, since the logic of the read circuit 26 changes, the logic taken from the memory circuit 25 is inverted and the potential of the pixel electrode 21 changes as described above. It should be obvious that the switching of the potentials of the pixel electrodes 21 is carried out successively, one line at a time, in accordance with the selection period of each scan line Yi. Unlike the potentials of these pixel electrodes 21 that switch, the counter electrode signal COM of the counter electrode 22 is fixed at the predetermined potential VC as described above, so that a voltage for displaying black or for displaying white is applied between the pixel electrode 21 and the counter electrode 22 while the polarity of such voltage is inverted. In this way, the electric fields applied to the liquid crystal volume elements 23 are switched, thereby realizing the AC driving of liquid crystals in the still picture mode.

In particular, the polarity inverting operation is carried out successively one line at a time (for the scan lines Yi) by the scan line driving circuit 12, so that with respect to the counter electrode 22 that is held at the predetermined potential VC, a load capacity to operate the scan line driving circuit 12 and for an operation inverting one line is sufficient to carry out the polarity inverting operation.

As described in detail above, according to the present exemplary embodiment, the following effects are obtained.

(1) In the present exemplary embodiment, the memory circuit 25 is supplied by the power supply selecting circuit 17 with a power supply that is switched based on switches in the logic of the polarity signal POL. At the same time, the pixel electrode 21 is supplied after switching to a read of the logic stored in the memory circuit 25 by the read circuit 26. This means that the pixel electrode 21 is supplied with an inversed polarity potential for the same tone in response to a switching of the logic of the polarity signal POL. By doing so, AC driving of the liquid crystals by switching the electric field between the pixel electrode 21 and the counter electrode 22 based on the polarity signal POL is realized while setting and holding the counter electrode 22 constant at the predetermined potential VC. At this point, since it is unnecessary to invert the polarity of the counter electrode 22 that has a large load capacity, the occurrence of a peak current during the switching of polarity is suppressed and a corresponding reduction can be made in the driving capability of the power supply used. In keeping with this reduction in the driving capability of the power supply, it is possible to reduce the power consumption thereof.

(2) In the present exemplary embodiment, a pair of potentials for the state of the memory circuit 25 is selected from a first pair and a second pair in accordance with the logic of the polarity signal POL, so that the construction used to supply the memory circuit 25 can be made extremely simple.

(3) In the present exemplary embodiment, the potential of the data signal supplied to the pixel electrode 21 can be set by the tone power supply selecting circuit 14 of the extremely simple construction that selects, in accordance with the logic of the polarity signal POL, one pair of potentials out of two pairs in which potentials for respective tones are paired.

(4) In the present exemplary embodiment, when the still picture mode is selected by the signal line control circuit 10, the tone power supply selecting circuit 14 does not select potentials for the respective tones of the data signal in accordance with the logic of the polarity signal POL, so that a reduction can be made in power consumption corresponding to the driving for the selection operation that is no longer necessary.

(5) In the present exemplary embodiment, in the still picture mode, the supplying to the power supply selecting circuit 17 and the read circuit 26 and holding of the polarity signal POL are switched according to the selected/unselected state of the scan lines Yi. Accordingly, when the polarity signal POL is inverted for every single frame, a polarity signal POL with inverted logic is supplied in accordance with the successive selections of the scan lines Yi and is held after selection, so that AC driving of the liquid crystals is realized. By doing so, in the still picture mode, the constructions for supplying the polarity signal POL to the power supply selecting circuit 17 and the read circuit 26 or for holding the polarity signal POL can be simplified.

Second Exemplary Embodiment

A second exemplary embodiment where the present invention has been applied to a liquid crystal display apparatus will now be described with reference to the drawings. It should be noted that this second exemplary embodiment is a construction where the potential VC of the counter electrode signal COM is set equal to the potential (VSS+, VDD−) for displaying white in the first exemplary embodiment, so that detailed description of parts that are the same has been omitted.

Figure 5:
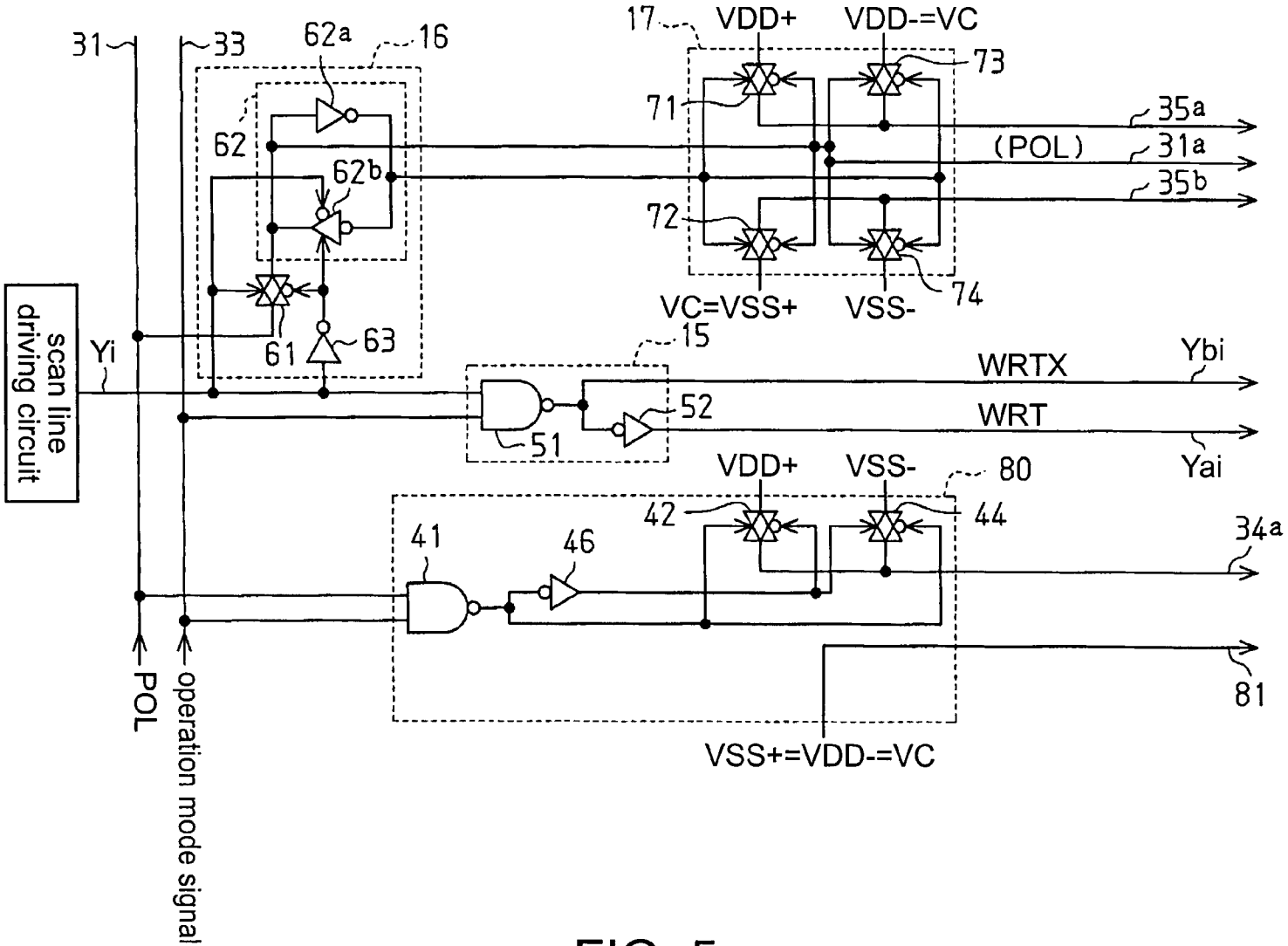
FIG. 5 is an electrical circuit schematic of a second exemplary embodiment.

FIG. 5 is an electrical circuit schematic showing the detailed construction of a liquid crystal display apparatus according to the present exemplary embodiment. As shown in this drawing, a construction for displaying white (analog switches 43, 45 and the white display power supply line 34*b*) is omitted from a tone power supply selecting circuit 80 according to the present exemplary embodiment. The data line scanning circuit 13 is continuously supplied with a power supply voltage with the potential VC via a white display power line 81. Power supply voltages with the potential VC are also applied to the analog switches 72, 73 of the power supply selecting circuit 17, respectively.

Figure 6:
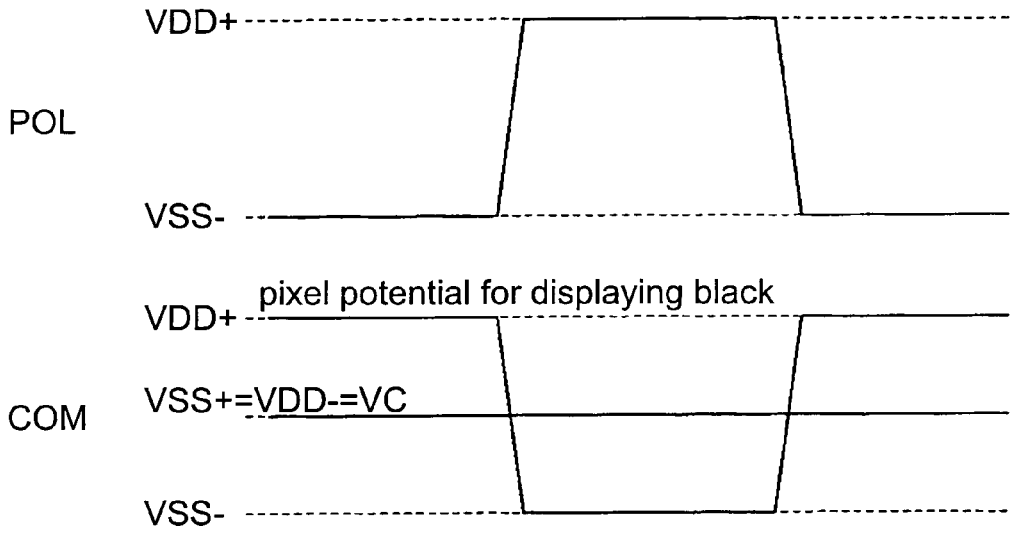
FIG. 6 is a timing chart showing how the same exemplary embodiment is driven.

FIG. 6 is a timing chart showing how the liquid crystal display apparatus according to the present exemplary embodiment is driven. The following describes the operation when the respective pixels are driven with reference to FIG. 6.

It should be noted that in the present exemplary embodiment also, the polarity signal POL is inverted for each frame and the liquid crystals are driven with AC according to a voltage-inverting driving method where a plus polarity signal and a minus polarity signal are alternately written into the pixel electrode 21 in accordance with the inversion of the polarity signal POL.

As shown in FIG. 6, the potentials VSS+, VDD− match the potential VC of the counter electrode signal COM. Accordingly, the relationship is VDD+>VSS+=VDD−=VC>VSS−. A voltage between the potentials VSS+, VC and a voltage between the potentials VC, VDD− are set at zero.

In the present exemplary embodiment also, the so-called "normally white mode" is used where a larger electric field is applied to the liquid crystal display apparatus corresponding to a display of black. It should be obvious that by inverting the magnitude relationship for the electric field applied to the liquid crystals according to the tone, it is possible to easily replace this with a "normally black mode". With the exception of the voltage corresponding to display of white becoming zero as described above, the various operations of the liquid crystal display apparatus corresponding to the operation mode signal are the same as in the first exemplary embodiment and therefore description of such has been omitted.

As described above, according to the present exemplary embodiment, the following effect is obtained in addition to the effects of the first exemplary embodiment described above.

(1) In the present exemplary embodiment the potentials (VSS+, VDD−) for displaying white in the respective pairs of data signals supplied to the pixel electrode 21 are set at the same predetermined potential (the counter electrode potential) VC as the counter electrode 22, so that the construction to supply power can be simplified by an amount corresponding to the decrease in the required types of potential.

Electronic Appliance

Next, an example where the liquid crystal display apparatus according to the exemplary embodiments described above, is used in an electronic appliance, will be described. This kind of electro-optic apparatus can be applied, for example, to a personal computer, a mobile computer, a car navigation system, a mobile telephone, a digital still camera, or a projector-type display apparatus. This appliance may also be applied to a variety of electronic appliances, such as a television set, a pager, an electronic organizer, a calculator, a word processor, a viewfinder-type or monitor-type video tape recorder, a workstation, a video telephone, a POS terminal, or an appliance equipped with a touch panel. When the electro-optic apparatus is applied to such appliances, the same effects as the exemplary embodiments described above can be achieved.

Mobile Telephone

Figure 7:
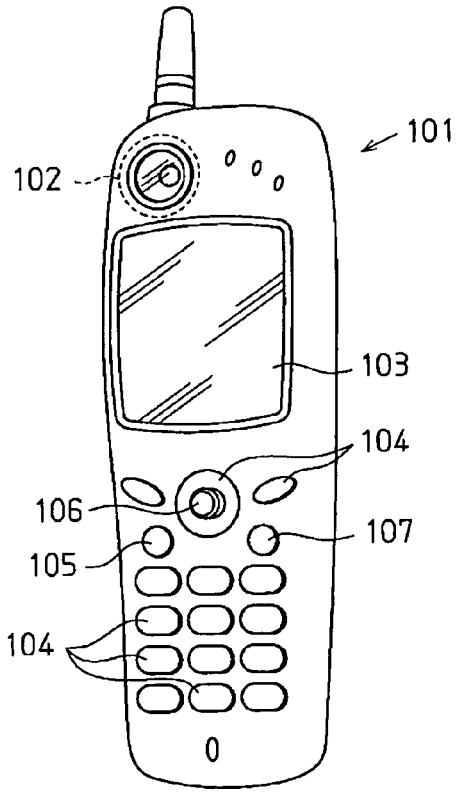
FIG. 7 is a schematic showing the construction of a mobile telephone.
Figure 8:
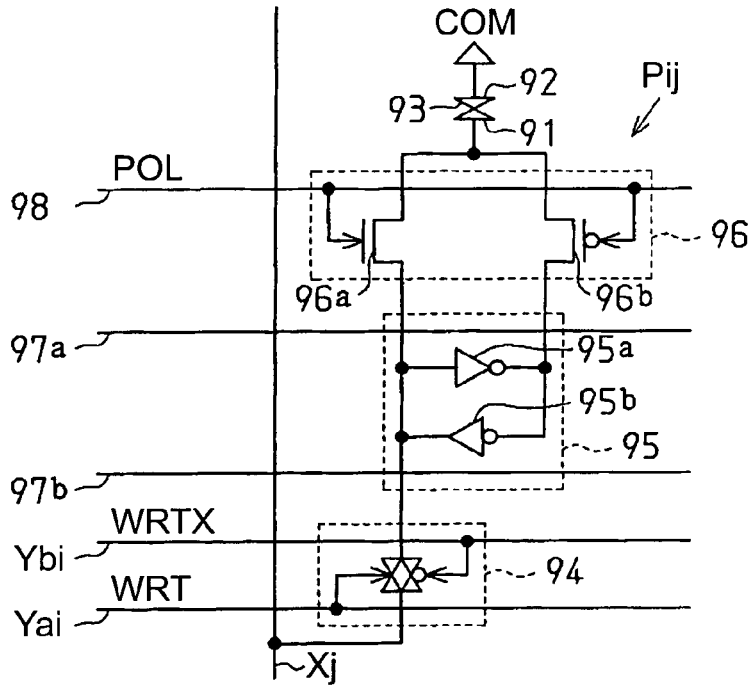
FIG. 8 is an electrical circuit schematic showing a related art example.
Figure 9:
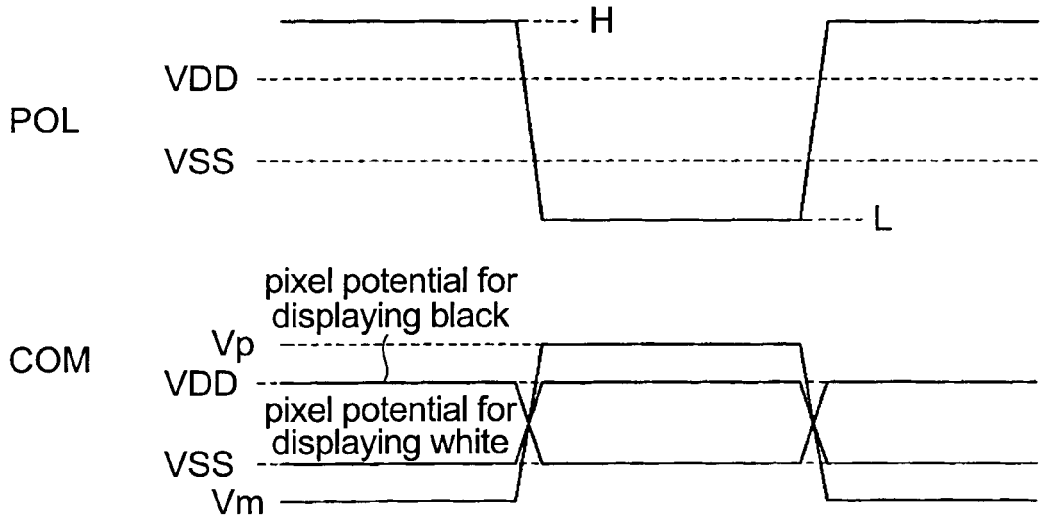
FIG. 9 is a timing chart showing how the related art example is driven.

As shown in FIG. 7, a mobile telephone 101 is equipped with an optical driving unit 102 and a monitor unit 103. The optical driving unit 102 includes parts such as a lens and a driving mechanism for focusing. The monitor unit 103 is composed of a liquid crystal display, for example. On this monitor unit 103, an image photographed using the optical driving unit 102, characters inputted from a keyboard 104, a menu screen, and the like are output and displayed. Accordingly, via the monitor unit 103, the unit can view an image that has been photographed or is being photographed and characters input from the keyboard 104.

In addition, the mobile telephone 101 includes a shutter button 105, a menu button 106, and a power button 107. By pressing the shutter button 105, data for a still picture is stored. When the menu button 106 is pressed, adjustment can be carried out for the brightness and contrast, etc., of the image displayed on the monitor unit 103. When the power button 107 is pressed, the power is turned on or turned off.

Modifications

The present invention is not limited to the exemplary embodiments described above, and a variety of modifications, such as those described below, are possible.

In the various exemplary embodiments described above, in the moving picture mode, the respective scan lines Yi are successively selected and the image is rewritten (the tones are changed). It is possible to use a driving method where the image is rewritten (the tones are changed) by selecting only scan lines or blocks of scan lines where there are pixels Pij whose tones in the present frame are changed from the previous frame. In this case it is possible to equally divide the selection period of the respective scan lines in accordance with the number of selected scan lines so that the time of one frame is kept constant. Alternatively, it is possible to lengthen or shorten one frame in accordance with the number of selected scan lines with the selection period of each scan line being kept constant.

The polarity inversing mode was described for an example of frame inversion, but it should be obvious that it is also possible to invert the polarity at freely chosen horizontal intervals.

In the above exemplary embodiments, the selection period of the scan lines Yi in the still picture mode may be set longer than the selection period of the scan lines Yi in the moving picture mode. In this case, the frequency of the selection operations is reduced and the power consumption can be reduced by an amount corresponding to the increase in the length of the selection periods of the scan lines Yi in the still picture mode.

Although examples where the present invention is applied to liquid crystal display devices are described in the above exemplary embodiments, the present invention is not limited to liquid crystal display devices. It should be obvious that the present invention can be applied to electro-optic apparatus that use electro-optic materials aside from liquid crystals and to electronic appliances that are equipped with such electro-optic apparatus.

What is claimed is:

1. An electro-optic apparatus, comprising:

a plurality of scan lines;

a plurality of data lines that intersect the scan lines;

pixel electrodes disposed at respective intersections of the scan lines and the data lines;

a counter electrode disposed opposite the pixel electrodes, the counter electrodes being set at a predetermined potential;

electro-optic material disposed between the respective pixel electrodes and the respective counter electrodes, a memory to store logic corresponding to a tone of a data signal supplied from the data lines to the pixel electrodes in accordance with logic of a polarity signal;

a power supply selecting device, the power supply selecting device switching between a first state in which a first potential and a second potential are supplied to the memory and a second state in which a third potential and a fourth potential are supplied to the memory, based on a switching of the logic of the polarity signal; and a reading device to switch a read of logic stored in the memory device based on the switching of the logic of the polarity signal, and supplying the pixel electrodes, the predetermined potential being lower than the first potential and the second potential and being higher than the third potential and the fourth potential.

2. The electro-optic apparatus according to claim 1, in accordance with the logic of the polarity signal, the power supply selecting device selecting one pair of potentials for the logic of the memory out of a first pair and a second pair and supplying the memory with the selected potentials.

3. The electro-optic apparatus according to claim 1, further comprising:

a tone power supply selecting device that selects, in accordance with the logic of the polarity signal, one pair of potentials for tones of the data signal supplied to the pixel electrodes, out of a first pair and a second pair.

4. The electro-optic apparatus according to claim 3, one potential in the respective pairs of potentials for tones in the data signal supplied to the pixel electrodes being set at the counter electrode potential.

5. The electro-optic apparatus according to claim 3, further comprising:

a control device to select one of a moving picture mode and a still picture mode as an operation mode; and a selection permitting device that prohibits supply of the data signal to the pixel electrodes in accordance with a selection of the scan lines when the still picture mode is selected by the control device, when the still picture mode is selected by the control device, the tone power supply selecting device does not select the potentials of the respective tones of the data signal in accordance with the logic of the polarity signal.

6. The electro-optic apparatus according to claim 5, further comprising:

a polarity signal processing device to supply, when the still picture mode is selected by the control device, the power supply selecting device and the reading device with a polarity signal in accordance with a selection of the scan lines, and holding the polarity signal and supplying the power supply selecting device and reading device with the held polarity signal in accordance with an unselection of the scan lines.

7. The electro-optic apparatus according to claim 6, when the still picture mode is selected by the control device, a scan line driving circuit operates as a polarity inverting circuit, the scan lines are successively selected one line at a time, and the polarity is successively inverted by the polarity signal processing device, and when the still picture mode is selected by the control device, a selection period of the scan lines is set longer than a selection period of the scan lines when the moving picture mode is selected.

8. A driving method for an electro-optic apparatus including a plurality of scan lines, a plurality of data lines that intersect the scan lines, pixel electrodes disposed at respective intersections of the scan lines and the data lines, counter electrodes disposed opposite the pixel electrodes, electro-optic material disposed between the respective pixel electrodes and the respective counter electrodes, and a memory to store logic corresponding to a tone of a data signal supplied from the data lines, the driving method comprising:

setting the counter electrodes at a predetermined potential; and switching between a first state in which a first potential and a second potential are supplied to the memory and a second state in which a third potential and a fourth potential are supplied to the memory, based on a switching of logic of a polarity signal, and switching a read of logic stored in the memory based on a switch of the logic of the polarity signal, the predetermined potential being lower than the first potential and the second potential and being higher than the third potential and the fourth potential.

9. An electronic appliance, comprising:

an electro-optic apparatus according to claim 1.

* * * * *